US008079099B1

(12) United States Patent
Brown et al.

(10) Patent No.: US 8,079,099 B1
(45) Date of Patent: Dec. 20, 2011

(54) WRAP FOR CONVALESCENT USE, PARTICULARLY FOR WHEELCHAIRS

(76) Inventors: Myra H. Brown, High Point, NC (US); Betsy S. Upton, Ocean Isle Beach, NC (US)

( * ) Notice: Subject to any disclaimer, the term of this patent is extended or adjusted under 35 U.S.C. 154(b) by 116 days.

(21) Appl. No.: 12/768,264

(22) Filed: Apr. 27, 2010

(51) Int. Cl.
*A47G 9/00* (2006.01)
*A41B 13/06* (2006.01)
*A47C 31/00* (2006.01)

(52) U.S. Cl. .... 5/485; 5/494; 5/482; 2/69.5; 297/219.12

(58) Field of Classification Search ..... 5/482, 485, 5/494; 297/188.14, 184.13, 219.12; 2/69.5, 2/88
See application file for complete search history.

(56) References Cited

U.S. PATENT DOCUMENTS

| | | | | |
|---|---|---|---|---|
| 2,712,133 | A * | 7/1955 | Coleman | 2/69 |
| 4,534,065 | A | 8/1985 | Comfort | 2/69.5 |
| 5,283,909 | A * | 2/1994 | Hill | 2/69 |
| 5,970,542 | A | 10/1999 | Mays | 5/485 |
| 6,394,543 | B1 * | 5/2002 | Dunne et al. | 297/219.12 |
| 6,643,870 | B2 | 11/2003 | Bertrand | 5/482 |
| 6,757,922 | B2 | 7/2004 | Chancey | 5/482 |
| 7,581,259 | B2 | 9/2009 | Thompson | 2/69.5 |
| 2006/0200906 | A1 | 9/2006 | Deering et al. | 5/482 |
| 2009/0025118 | A1 | 1/2009 | Pothier | 2/69.5 |

* cited by examiner

*Primary Examiner* — Jonathan Liu
(74) *Attorney, Agent, or Firm* — MacCord Mason PLLC

(57) ABSTRACT

An apparatus for wrapping a person sitting in a wheelchair having foot pedals includes a sheet having a top, bottom, right, center and left. The center has a first upwardly-open pocket and one of the right and left has a second upwardly-open pocket. The sheet is placed on a wheelchair with the pedals in the first pocket. A person can sit on the sheet on the wheelchair. The portion of the sheet having the second pocket is wrapped around the person's legs with the person's feet in the second pocket, and the final portion is wrapped around the person's legs.

11 Claims, 3 Drawing Sheets

WRAP FOR CONVALESCENT USE, PARTICULARLY FOR WHEELCHAIRS

BACKGROUND OF THE INVENTION

The present invention relates to wraps for people to use to keep warm, particularly, when sitting in a wheel chair.

People in nursing homes, convalescent facilities, rehabilitation facilities, hospitals, in-home care and in other instances where they may not be able to walk or may not be able to walk for very long often use wheel chairs for mobility. Wheel chairs typically have a chair-like configuration, two large wheels on either side of the chair-like configuration and foot pedals forward of the chair-like configuration. The person sits in the chair and places his or her right and left feet on the foot pedals and can be moved about by rolling the chair on the wheels. One of the issues that such people encounter is the fact that they may get cold sitting in such a situation, particularly those with impaired circulation. Also, even people without impaired circulation who may be spending an extended period of time outdoors would appreciate having a wrap around their legs to help keep warm.

When implemented in nursing homes in particular, various regulatory constraints limit the design of wraps. In particular, many states have requirements that a person not be constrained against moving or bound to the chair. Some wrap concepts that have been proposed would violate such regulations because they do provide a binding affect when the wrap is held in place. Such holding in place is often useful when the person is sitting in a wheelchair, since motion of the wheelchair or air currents may cause a wrap to become un-wrapped or to tangle in moving parts of a wheel chair. Accordingly, there is a need in the art for a wrap that is particularly well suited for a person who is sitting in a wheel chair, but that can, of course, be used for other uses.

SUMMARY OF THE INVENTION

The present invention fulfills one or more of these needs in the art by providing an apparatus for wrapping a person sitting in a wheelchair having foot pedals. A sheet of fabric is included of a size in one direction to extend from underfoot of the person to at least the waist of the person and sized transversely to the one direction to wrap approximately one and one half times around the person. The sheet of fabric has a top end and a bottom end, the bottom end having right, center and left portions. The center portion has a first upwardly-open pocket on a rear face of the sheet of fabric, and one of the right and left portions has a second upwardly-open pocket on a front face of the sheet of fabric. The sheet of fabric can be placed on a wheelchair having pedals with the pedals fitting into the first pocket on the center portion. A person can sit on the sheet of fabric on the wheelchair, the portion of the sheet having the second pocket can be wrapped over the person's legs with the person's feet inserted into the second pocket, and the one of the right and left portions not having the second pocket can be further wrapped over person's legs. The scope of the invention includes modifications of the second pocket to include both feet and the pedals.

On one embodiment, the bottom end of the sheet of fabric has two spaced apart slits extending in the one direction that divide the bottom end into the right, center and left portions. The center portion may have a flap between the two slits that is folded upward toward the top end and side edges of the flap are stitched to the sheet of fabric to form the first pocket. In addition, the one of the right and left portions that has the second pocket may have a flap laterally of a slit folded upward toward the top end and side edges of the flap are stitched to the sheet of fabric to form the second pocket. Alternatively, only the one of the right and left portions that has the second pocket has a flap laterally of a slit folded upward toward the top end and side edges of the flap that are stitched to the sheet of fabric to form the second pocket.

The sheet of fabric is preferably polar fleece. The sheet of fabric may be other materials, including being selected from the group consisting of natural fleece, synthetic fleece, woolens, cotton, quilting, knitted fabric, non-wovens and wovens.

Preferably, the top end of the sheet of fabric has satin binding fabric.

Desirably, at least one of the pockets has a tacking closure approximately halfway across the portion of the sheet of fabric on which the pocket is located. Preferably, the tacking closure is releasable and re-formable, such as a hook and loop closure.

In some embodiments, the sheet of fabric has a closure to hold the one of the right and left portions not having the second pocket that is wrapped over person's legs in such wrapped condition.

The invention can also be considered as a method of helping a person sitting in a wheelchair having foot pedals stay warm including placing a sheet of fabric on a wheelchair having pedals, including inserting the pedals into a first pocket on a backside of a center portion of the sheet of fabric, placing the person in sitting position on the sheet of fabric on the wheelchair, wrapping a first lateral portion of the sheet having a second pocket around the person's legs including inserting the person's feet into a second pocket on the portion, and wrapping a second lateral portion of the sheet over the first lateral portion and around person's legs.

The method typically includes inserting the pedals into a first pocket that includes opening a tacking closure of the first pocket approximately halfway across the portion of the sheet of fabric on which the first pocket is located. Also typical is for inserting the person's feet into a second pocket to include opening a tacking closure of the second pocket approximately halfway across the portion of the sheet of fabric on which the second pocket is located. The method may include actuating a closure on the sheet of fabric to hold the second lateral portion around the person's legs in the wrapped condition.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
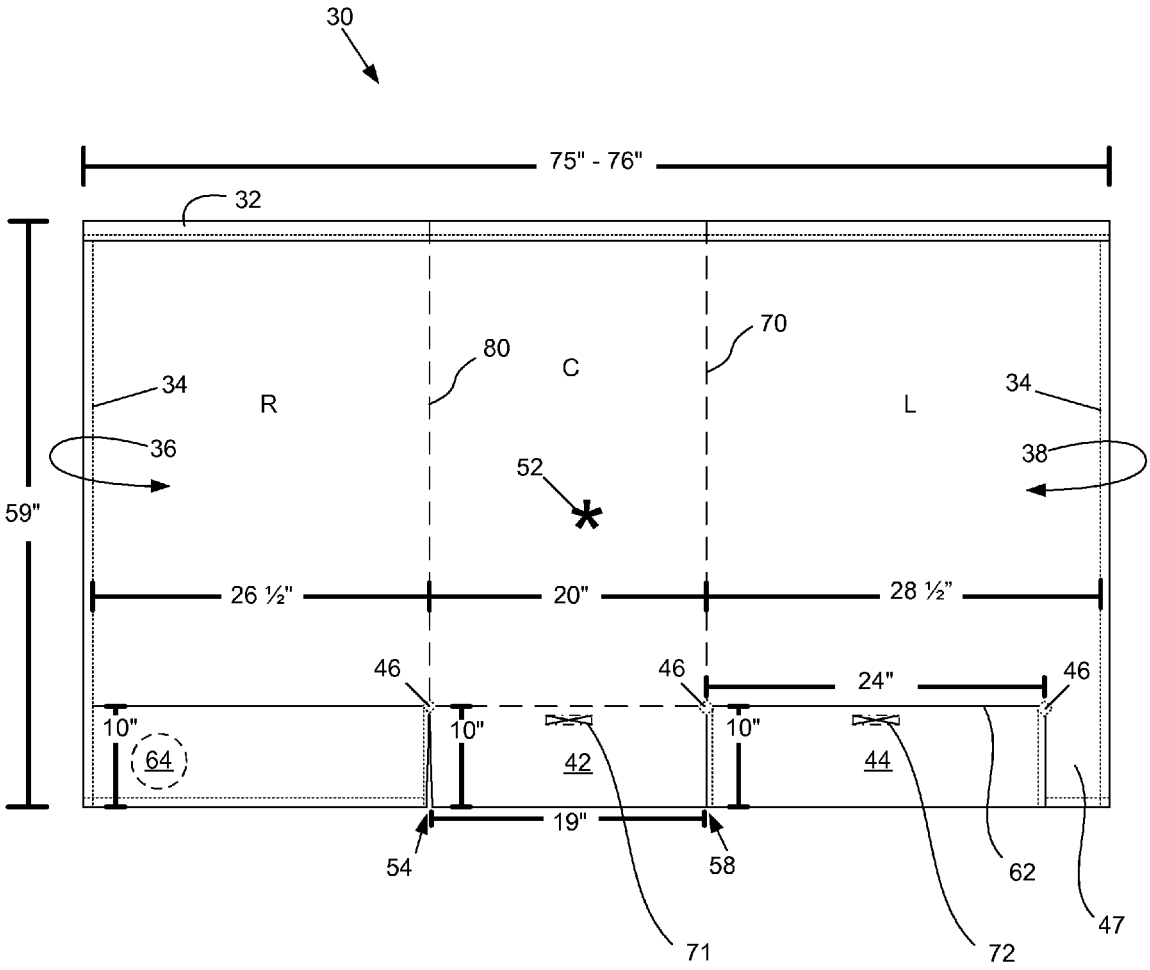
FIG. 1 is a front view of the wrap, not in use.

As seen in FIG. 1, a wrap 30 is provided of generally rectangular shape. Other shapes may also be suitable. In a preferred embodiment, the rectangle is about 75 to 76 inches wide and about 59 inches high. Other sizes can be used, particularly for pediatric use. The perimeter of the wrap 30 is bound at the top 32 with a satin blanket binding. Other materials can be used, as well, but satin makes a nice contact touch for the person. Side edges 34 are hemmed in a conventional fashion.

The wrap 30 includes a central section C of a width of about 20 inches. A left section L is about 28½ inches wide and a right section R that is about 26½ inches wide. Other dimensions can be used. The central section C has a lower pocket 42 which is made by cutting slits up a partial distance along lines 80 and 70, so that a flap can be formed to fold upward toward the center 52 of the central panel C. Side edges of the flap are preferably stitched to make the pocket shape. A Velcro connection 71 is made to bind central portions of the thus made pocket 42. A similar construction is used for a pocket 44 on the left side section L. The ends of the slits made in the wrap 30 can be bound securely with reinforcing tabs 46. If desired, a decorative logo or the like 64 can be applied to the side of the right most panel R, but on the reverse side of the view seen in FIG. 1, so that logo 64 is shown in phantom in FIG. 1.

Figure 1A:
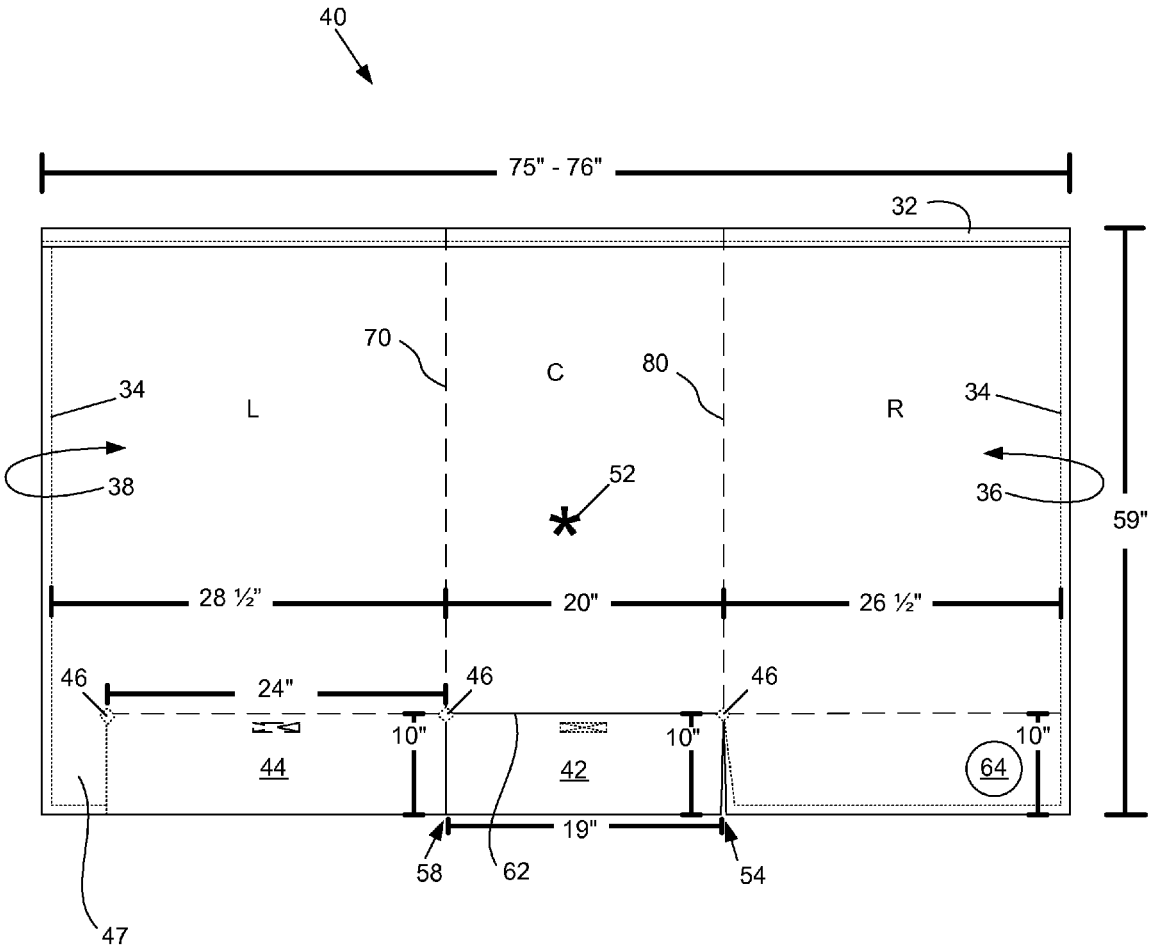
FIG. 1*a* is a rear view of the wrap, not in use.

FIG. 1*a* shows the same item in reverse, so that the emblem 64 is seen. As can be seen, central pocket 42 and the pocket 44 on the left panel L are formed on opposite faces of the wrap 30. In use, the central portion C is laid into the seat and back of the wheel chair and the pocket 42 is fitted over the pedal of the wheel chair. The person can then sit in the wheel chair on the central chair portion C. The left panel L is then pulled over the person, so that the pocket 44 in the left panel L is facing the person. The person can put his or her feet into the pocket 44, typically with one foot on either side of the Velcro attachment 72. The Velcro attachment 72 permits selective engagement of the top of the pocket or not, depending on user comfort or preference. The left most portion 47 of the left panel is free of the pocket to extend down along side of the person as sitting in the wheel chair.

The right panel R then can be pulled over the front of the legs and lap of the person sitting in the wheel chair, so that the emblem 64 is exposed. The end result of this deployment of the various pockets can be seen in FIG. 2. Thus, the person is sitting in the wheel chair, shown in phantom, with the central panel C underneath the person and its pocket 42 encapsulating the pedals of the wheel chair. The left panel L is wrapped first over the legs of the person and the feet of the person are inserted into its pocket 44. (In some embodiments a pocket can surround both the feet and the pedals.) The right panel R is then wrapped over the outermost portion of the left panel L.

The various locations for Velcro have been mentioned hereinabove. Of course, selective fastening mechanisms, such as snap, safety pins, or other releasable connections can be substituted. In fact, such top bindings of the two pockets 42 and 44 can be eliminated altogether, although they are preferred.

The selection of the location of the pocket that covers the feet as being on the left panel L could of course be replaced with a pocket on the right panel R without a pocket on the left panel L. A further possibility would be to have pockets on both sides to provide a second layer of insulation for the feet, although some state regulations may regard that as binding, in which case it would not be acceptable for facilities subject to such regulations.

Figure 2:
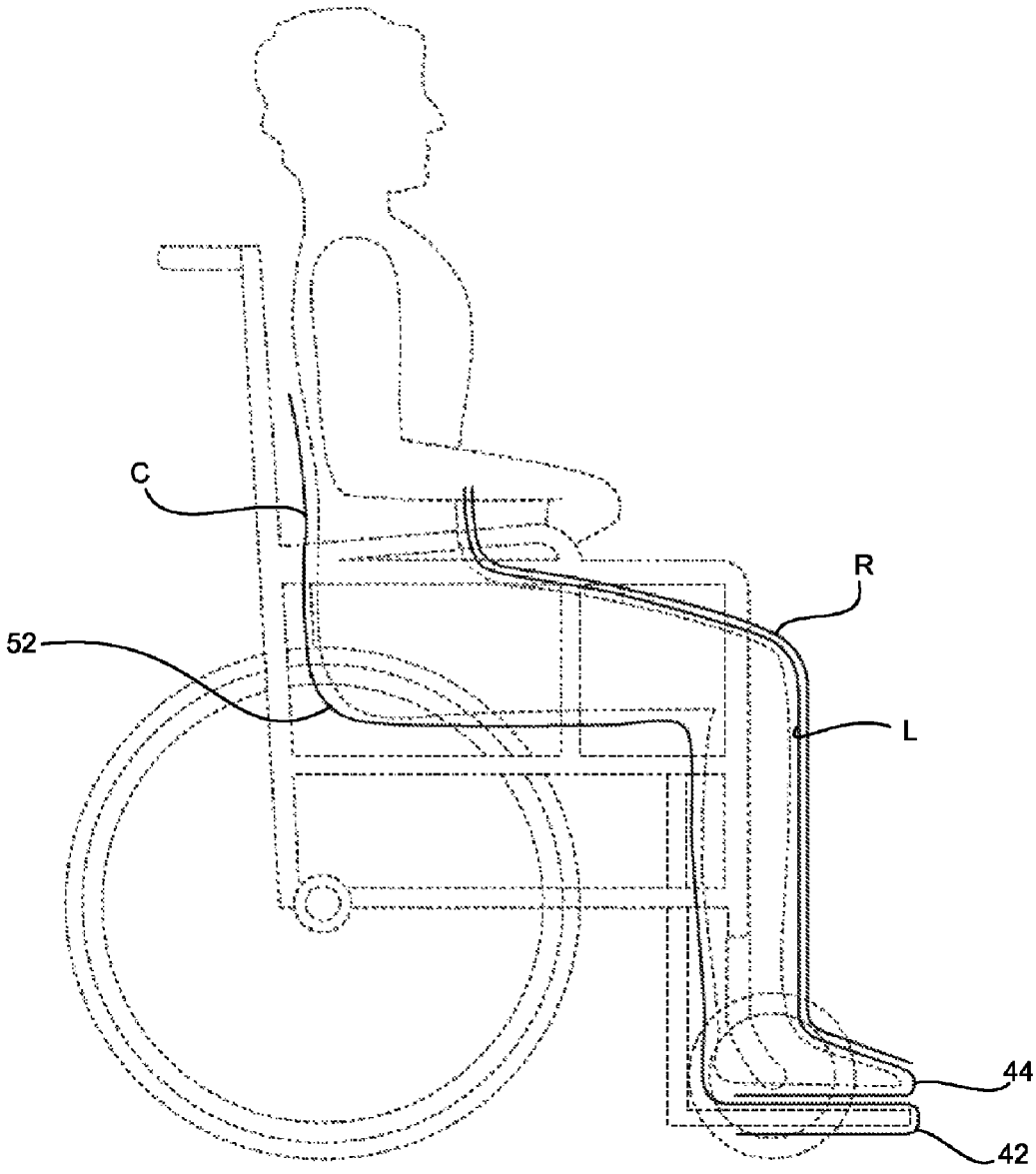
FIG. 2 is a sectional view of the embodiment showing the relationship of the wrap to a person sitting in a wheelchair having foot pedals.

FIG. 2 shows the wheel chair in dotted lines, as well as an outline of a person using the wrap, also shown in dotted lines. Neither the person or the wheel chair are to be considered part of the invention.

Although, the invention is shown as being used by a person sitting in a wheel chair, the wrap can, of course, be used in other circumstances.

This blanket allows for quick release of patient as it has nothing securing patient at the waist to the chair or binding the legs to the chair.

Two yards six inches for 60 inches wide Polar fleece is preferred, but other sizes can be used, depending on overall size requirements. Other materials than Polar fleece can be used including woolen, quilting, cotton, polyester, other synthetics. The wrap can be woven, knitted, netted or be an extruded sheet material. A plastic sheet laminated to the wrap may add water resistance, or a plastic sheet alone can be used.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for wrapping a person sitting in a wheelchair having foot pedals comprising a sheet of fabric of a size in one direction to extend from underfoot of the person to at least the waist of the person and sized transversely to the one direction to wrap approximately one and one half times around the person, the sheet of fabric having a top end and a bottom end, the bottom end having right, center and left portions, wherein the bottom end of the sheet of fabric has two spaced apart slits extending in the one direction that divide the bottom end into the right, center and left portions, the center portion having a first upwardly-open pocket on a rear face of the sheet of fabric, and one of the right and left portions having a second upwardly-open pocket on a front face of the sheet of fabric, whereby the sheet of fabric can be placed on a wheelchair having pedals with the pedals fitting into the first pocket on the center portion, a person can sit on the sheet of fabric on the wheelchair, the portion of the sheet having the second pocket can be wrapped over the person's legs with the person's feet inserted into the second pocket, and the one of the right and left portions not having the second pocket can be further wrapped over person's legs.

2. An apparatus as claimed in claim 1 wherein the center portion has a flap between the two slits that is folded upward toward the top end and side edges of the flap are stitched to the sheet of fabric to form the first pocket.

3. An apparatus as claimed in claim 2 wherein the one of the right and left portions that has the second pocket has a flap laterally of a slit folded upward toward the top end and side edges of the flap are stitched to the sheet of fabric to form the second pocket.

4. An apparatus as claimed in claim 1 wherein the one of the right and left portions that has the second pocket has a flap laterally of a slit folded upward toward the top end and side edges of the flap are stitched to the sheet of fabric to form the second pocket.

5. An apparatus as claimed in claim 1 wherein the sheet of fabric is polar fleece.

6. An apparatus as claimed in claim 1 wherein the sheet of fabric is selected from the group consisting of natural fleece, synthetic fleece, woolens, quilting, knitted fabric, non-wovens and wovens.

7. An apparatus as claimed in claim 1 wherein the top end of the sheet of fabric has satin binding fabric.

8. An apparatus as claimed in claim 1 wherein at least one of the pockets has a tacking closure approximately halfway across the portion of the sheet of fabric on which the pocket is located.

9. An apparatus as claimed in claim 8 wherein the tacking closure is releasable and re-formable.

10. An apparatus as claimed in claim 1 wherein the sheet of fabric has a closure to hold the one of the right and left portions not having the second pocket that is wrapped over person's legs in such wrapped condition.

11. An apparatus for wrapping a person sitting in a wheelchair having foot pedals comprising a sheet of fabric of a size in one direction to extend from underfoot of the person to at least the waist of the person and sized transversely to the one direction to wrap approximately one and one half times around the person, the sheet of fabric having a top end and a bottom end, the bottom end having right, center and left portions, wherein the bottom end of the sheet of fabric has two spaced apart slits extending in the one direction that divide the bottom end into the right, center and left portions, the center portion having a first upwardly-open pocket on a rear face of the sheet of fabric made of a flap between the two slits that is folded upward toward the top end and side edges of the flap are stitched to the sheet of fabric to form the first pocket, one of the right and left portions having a second upwardly-open pocket on a front face of the sheet of fabric and wherein the one of the right and left portions that has the second pocket has a flap laterally of a slit folded upward toward the top end and side edges of the flap are stitched to the sheet of fabric to form the second pocket, at least one of the pockets having a closure approximately halfway across the portion of the sheet of fabric on which the pocket is located, whereby the sheet of fabric can be placed on a wheelchair having pedals with the pedals fitting into the first pocket on the center portion, a person can sit on the sheet of fabric on the wheelchair, the portion of the sheet having the second pocket can be wrapped over the person's legs with the person's feet inserted into the second pocket, and the one of the right and left portions not having the second pocket can be further wrapped over person's legs, and wherein the sheet of fabric has a closure to hold the one of the right and left portions not having the second pocket that is wrapped over person's legs in such wrapped condition.

* * * * *